US005468201A

United States Patent [19]

Minoura

[11] Patent Number: 5,468,201

[45] Date of Patent: Nov. 21, 1995

[54] LOADING APPARATUS FOR EXERCISE DEVICE

[75] Inventor: Koji Minoura, Gifu, Japan

[73] Assignee: Minoura Co., Ltd., Gifu, Japan

[21] Appl. No.: 14,684

[22] Filed: Feb. 9, 1993

Related U.S. Application Data

[63] Continuation-in-part of Ser. No. 509,539, Mar. 30, 1990, Reissue Patent No.34,479.

[30] Foreign Application Priority Data

Dec. 25, 1992 [JP] Japan ..... 4-347239

[51] Int. Cl.[6] ..... A63B 23/04

[52] U.S. Cl. ..... 482/61; 482/63; 482/903

[58] Field of Search ..... 482/60, 61, 62, 482/63, 903, 1–10

[56] References Cited

U.S. PATENT DOCUMENTS

| | | | |
|---|---|---|---|
| 3,831,942 | 8/1974 | Del Mar | 482/63 |
| 4,152,617 | 5/1979 | Janson | 310/103 |
| 4,188,620 | 2/1980 | Lamare et al. . | |
| 4,441,705 | 4/1984 | Brown | 482/61 |
| 4,520,284 | 5/1985 | Wolcott | 310/42 |
| 4,775,145 | 10/1988 | Tsuyama . | |
| 4,826,150 | 5/1989 | Minoura | 482/61 |
| 4,838,544 | 6/1989 | Sasakawa | 482/62 |
| 4,853,574 | 8/1989 | Estaque . | |
| 4,898,379 | 2/1990 | Shiba | 482/61 |
| 5,051,638 | 9/1991 | Pyles . | |

*Primary Examiner*—Stephen R. Crow
*Attorney, Agent, or Firm*—Hickman & Beyer

[57] ABSTRACT

The loading apparatus includes a rotary disk that is rotated by a pair of pedals, in order to generate a desired resistive load. A rotary shaft is connected to the rotary disk, and applied the resistive load to the bicycle wheel. A pair of eddy current generating members generate a user controlled, variable eddy current on the rotary disk. Each eddy current generating member includes one set of magnets, such that these magnets are generally oppositely disposed with respect to the rotary disk. Each set of magnets includes a plurality of magnets of alternating polarities, there are concentrically continuously arranged around the rotary shaft.

13 Claims, 7 Drawing Sheets

LOADING APPARATUS FOR EXERCISE DEVICE

This application is a continuation in part of the United States patent reissue application Ser. No. 509,539, filed in Mar. 30, 1990, now Reissue Patent No. 34,479 which in turn, relates to U.S. Pat. No. 4,826,150, issued in May 2, 1989, both of which are incorporated herein by reference.

BACKGROUND OF THE INVENTION

1. Field of the Invention

The present invention relates to an exercise device for holding a bicycle rear wheel in order to produce a similar effect that of real bicycle racing. More particularly, the invention pertains to a apparatus for applying a controllable resistive load to the bicycle pedals.

2. Description of the Related Art Exercise devices that are set on the floor for holding the rear wheel of the bicycle are available on the market. These devices generally permit the user to obtain a similar exercise effect to that obtained by an actual racing bicycle.

A typical exercise device includes an apparatus for applying resistance to the rear wheel, proportionally to the rotating velocity of the rear wheel. The user's physical strength and health condition would enable the user to vary the resistance value.

A conventional loading apparatus has fans that generate variable air resistance on the pedals. This loading apparatus generates loud noise, and causes the fans to disturb and to spread the settled dust surrounding the exercise apparatus. Thus, the use of these conventional exercise device would generally be confined to areas that are regularly dusted and maintained. Additionally, these conventional exercise devices could not be efficiently used in wide open places, such as on the beach, where air draughts would counter act, and exert undesirable force on the fans spread of dust since the air is disturbed with the fans.

Another proposed loading apparatus includes a brake for engaging a rotary disk fixed on a shaft. The shaft is driven by the rear wheel of the bicycle. Therefore, the brake generates a frictional resistance that is proportional to the strenuousness of the user's exercise. However, this device uses frictional resistance. Therefore, the resistance of the brake decreases as the engaging portions become worn out, and will eventually result in the inability to adjust the desired resistance accurately. Also frequent maintenance is required for the brake which would require repeated replacement.

In order to solve these problems, U.S. Pat. No. 4,826,150, discloses an exercise device with a magnetic load resistive apparatus. As shown in FIG. 8, the load resistive apparatus includes a rotary shaft 63 which supports the bicycle. A rotary metal disk 60 is fixed to one end of the rotary shaft, and a pair of disks 61 are disposed on the opposite sides of the rotary disk 60. The rotary disk 60 includes a plurality of permanent magnets 62 that are concentrically arranged around the rotational axis of the disk 61. The rotation of the disk 60 and the magnetic flux of the opposite by disposed magnets 62, generate an eddy current. The resistive load, which is generated by the eddy current on the rotary disk, is transmitted to the rear wheel of the bicycle via the rotary shaft 63. By adjusting a control knob or adjusting handle, the permanent magnets 62 are circularly moved, thus changing the amount of the magnetic flux, which, in turn, adjusts the magnitude or value of the resistive load. The noise level generated by this magnetic load resistive apparatus is low since the resistive load is generated magnetically. Additionally maintenance need is reduced and facilitated, as minimal wear takes place. Moreover, the resistive load can be adjusted easily.

In the above loading apparatus, the position of the permanent magnets, on one side of the rotary disk, can be shifted to face the spaces formed between the permanent magnets on the other side of the rotary disk, because the intervals between the circularly shaped permanent magnets are equidistally spaced apart. The two sets of permanent magnets that are disposed on either side of the rotary disk are not aligned with one another. Consequently, the magnetic flux does not change linearly, but rather changes non-linearly as a function of the adjustment or displacement of the control knob, as illustrated in FIG. 9. Therefore, the magnetic flux and the load will change disproportional with the positional displacement of the control knob. It would also be difficult for the user to adjust the resistive load due to the non-linear relationship between the resistive load and the knob displacement. While the user would eventually learn to accurately control the resistive load, and in certain applications, the non-linear relationship is desirable, there remains a need for a new loading apparatus that is easily and quickly controlled by the majority of users.

SUMMARY OF THE INVENTION

Accordingly, it is a primary objective of the present invention to provide a new resistance loading apparatus for use with an exercise device. The loading apparatus offers generally linear relationship between the resistive load and the positional displacement of the control knob.

To achieve the forgoing and other objects, and in accordance with the purpose of the invention, there is disclosed a loading apparatus for use with an exercise device. The loading apparatus includes a rotary disk that is rotated by a pair of pedals, in order to generate a desired resistive load. A rotary shaft is connected to the rotary disk, and applies the resistive load to the bicycle wheel. A pair of eddy current generating members generate a user controlled, variable eddy current on the rotary disk. Each eddy current generating member includes one set of magnets, such that these magnets are generally oppositely disposed with respect to the rotary disk. Each set of magnets includes a plurality of magnets of alternating polarities, there are concentrically circularly arranged around the rotary shaft.

Consequently, the resistive load is changed substantially, linearly and proportionally with the displacement of the control or adjusting knob, since the permanent magnets are adjacently arranged to form a substantially continuous circular arrangement. This will allow the user to easily select, vary and control the resistive load.

BRIEF DESCRIPTION OF THE DRAWINGS

The features of the present invention that are believed to be novel are set forth with particularity in the appended claims. The invention, together with the objects and advantages thereof, may best be understood by reference to the following description of the preferred embodiments, together with the accompanying drawings, in which:

FIGS. 1 through 7 illustrate an embodiment of the present invention, wherein:

FIG. 1 is a perspective view of a loading apparatus in accordance with the preferred embodiment of the present invention;

FIG. 2 is a side elevational view of a bicycle supported by an exercise device using the resistance loading apparatus of FIG. 1;

FIG. 3 is a partly cross-sectional view of the resistance loading apparatus of FIG. 1;

FIG. 4 is a partly cross-sectional view of the resistance loading apparatus taken along line A—A, and showing of the FIG. 3, arrangement of several permanent magnets for using part of the resistance loading apparatus;

FIG. 5 is a front view of the resistance loading apparatus of FIGS. 3 and 4, showing a control knob;

FIG. 6(*a*) is a schematic illustration of the magnetic flux on a rotary disk forming part of the resistance loading apparatus of FIGS. 3 through 5, with a low or "L" setting;

FIG. 6(*b*) is a schematic illustration of the magnetic flux on the rotary disk of FIG. 6(*a*), with a medium setting;

FIG. 6(*c*) is a schematic illustration of the magnetic flux on the rotary disk of FIGS. 6(*a*) and 6(*b*), with a high or "H" setting;

FIG. 7 is a graph showing the relationship between the angular displacement of the control knob and the resistive load on the foot pedals;

DETAILED DESCRIPTION OF THE PREFERRED EMBODIMENT

A preferred embodiment of a resistance applying device for an exercise device according to the present invention will now be described referring to FIGS. 1 thorough 7.

Figure 1:
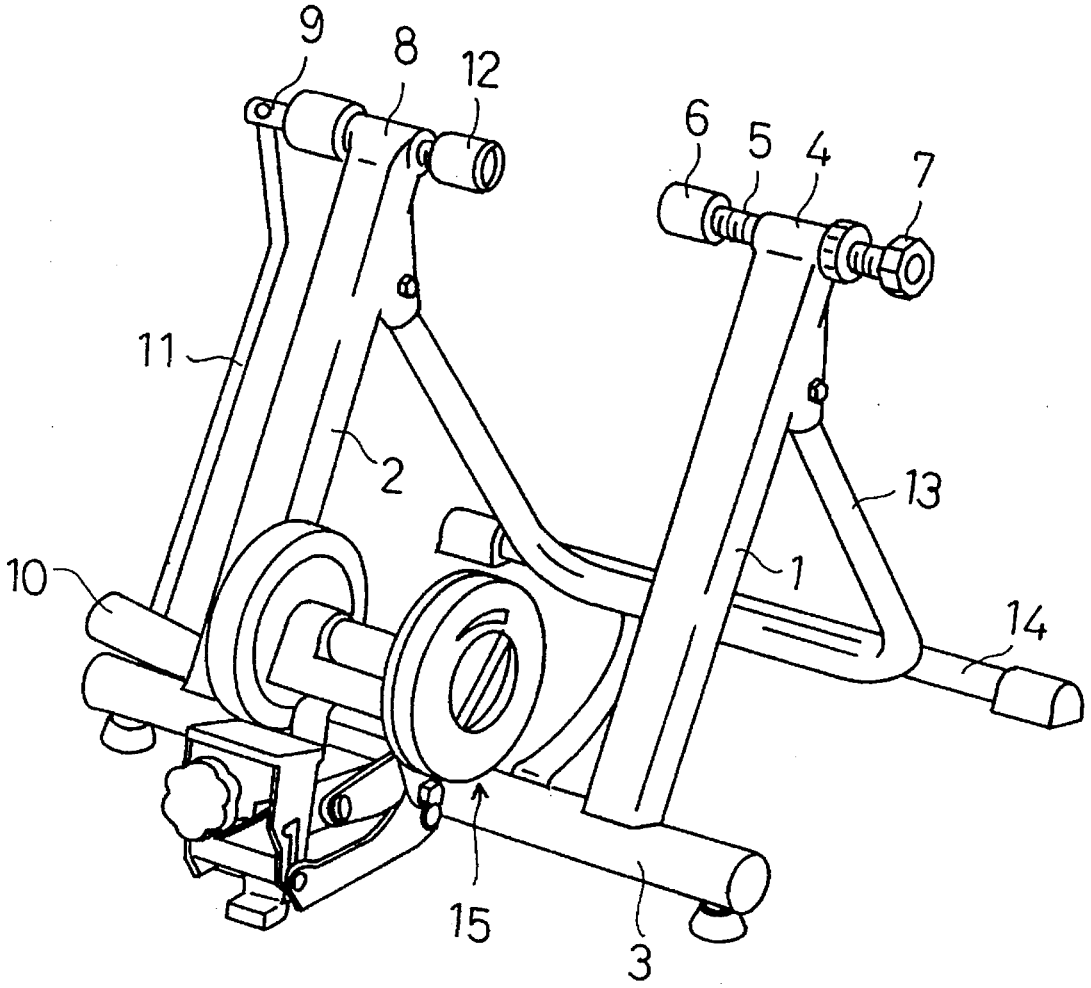

As shown in FIG. 1, a first and a second legs 1, 2 are obliquely set on right and left sides of a bicycle exercise stand respectively. The bottom portion of each leg 1, 2 is connected to a first horizontal frame 3. A sleeve 4 extends at the upper portion of the first leg 1, and accommodates a bolt 5. A holder 6 is mounted on the inner end of the bolt 5. The position of the holder 6 is adjustable with the knob 7. A sleeve 8 extends at the upper portion of the second leg 2 to hold a slider 9. The outer end of the slider 9 and the pedal 10 are operably connected to each other, by means of a lever 11. By operating the pedal 10, the lever 11 moves the slider 9 horizontally, inside the sleeve 8, in order to adjust the position of the holder 12 which is mounted on the inner end of the slider 9.

Top upper ends of a frame 13 are connected to the upper portions of the first and the second legs 1, 2. The second horizontal frame 14 is connected to the bottom part of the frame 13.

Figure 2:
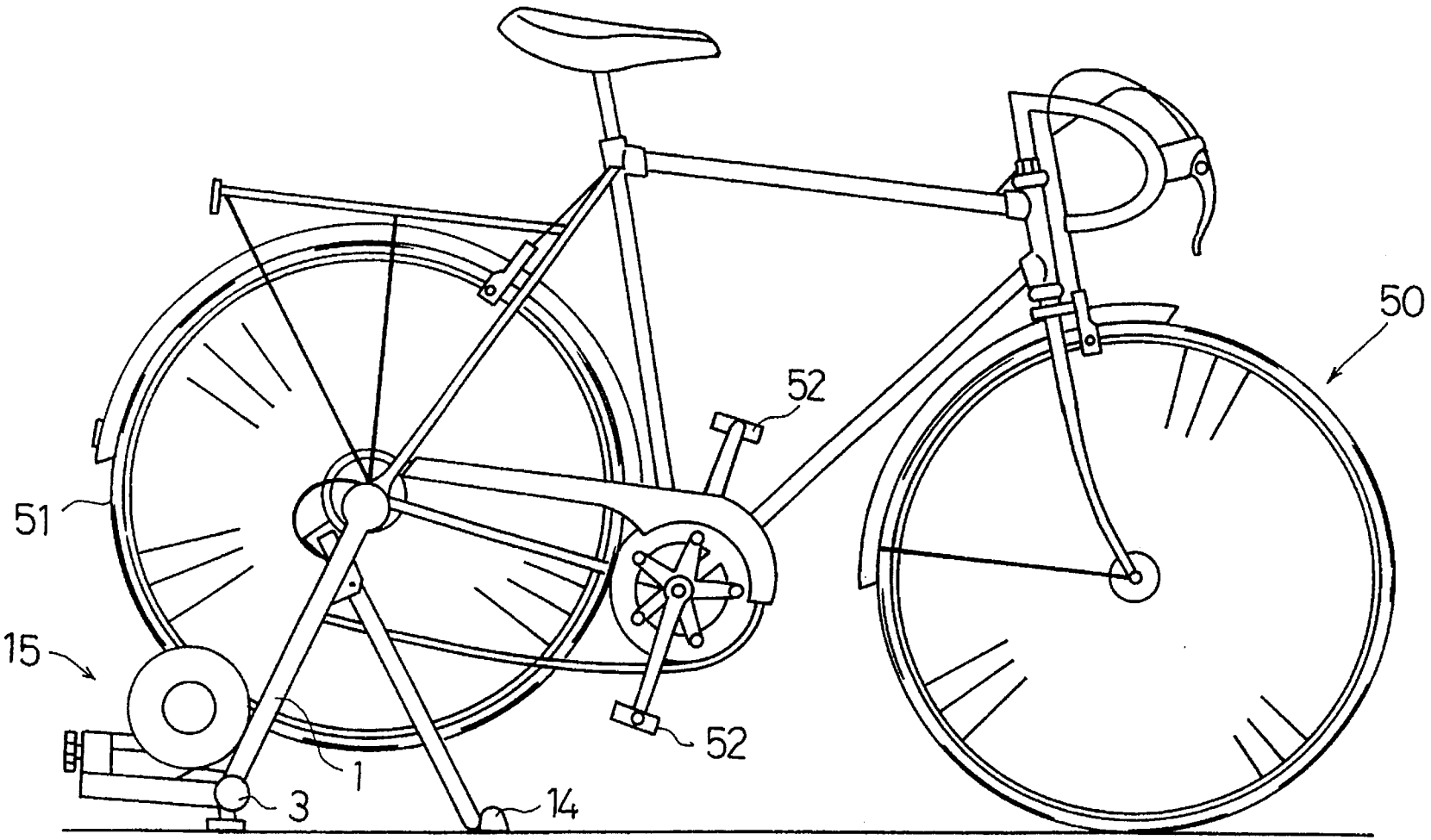

The loading apparatus 15 is secured to the first horizontal frame 3. As shown in FIG. 2, the rear wheel 51 of the bicycle 50 is rested on the loading apparatus 15. One hub of the rear wheel 51 of the bicycle 50 is clamped by the positional adjustment of the holders 6, 12.

The loading apparatus is explained hereinafter, with reference to FIGS. 3, 4. The rotary shaft 16 is rotatably retained by the support frame 18, via a pair of bearings 17. The driving cylinder 19 supports the rear wheel 51, and is fixed to the central portion of the rotary shaft 16. The driving cylinder 19 rotates simultaneously with the rear wheel 51, as the foot pedals 52 of the bicycle 50 cause the rear wheel 51 to rotate.

A flange 20 is secured on a first end of the rotary shaft 16. The flywheels 21 are mounted on the flange 20, by means of the screws 20*a*, to exert momentum on the foot pedals 52, through the shaft 16, during the operation of the foot pedals 52. Each flywheel 21 is preferably made of steel. Several flywheels 21 can be mounted on the cylinder 19 (three flywheels are used in the embodiment). The user can adjust the number of the flywheels 21 to better suit his/her physical strength and endurance level. A user of this exercise device can experience real bicycle riding by setting the appropriate number of the flywheels 21 on the rotary shaft 16.

A cup shaped inner case 22 is connected to the support frame 18, for covering the flywheels 21. A cup shaped outer case 23 is fixed to the inner case 22, for accommodating the flywheels 21. The flywheels 21 could be readily replaced when the outer case 23 is removed from the inner case 22.

A rotary metal disk 24 is secured to a second end of the rotary shaft 16, via the bush 25. A cup shaped inner case 26 is secured to the side of the support frame 18, for covering the rotary disk 24. Further, a cup shaped outer case 27 is secured to the inner case 26, for accommodating the rotary disk 24.

Arcuately-shaped permanent magnets 28 are secured to a mounting disk 29, inside the inner case 26, in the vicinity of the rotary disk 24. As shown in FIG. 4, the magnets 28 are juxtaposedly arranged to form generally a circle with alternating polarities, on the mounting disk 29. Heat radiating holes 24*a* are closely, substantially, concentrically and continuously arranged around the rotational axis of the rotary disk 24, at the inner portion thereof.

Figure 3:
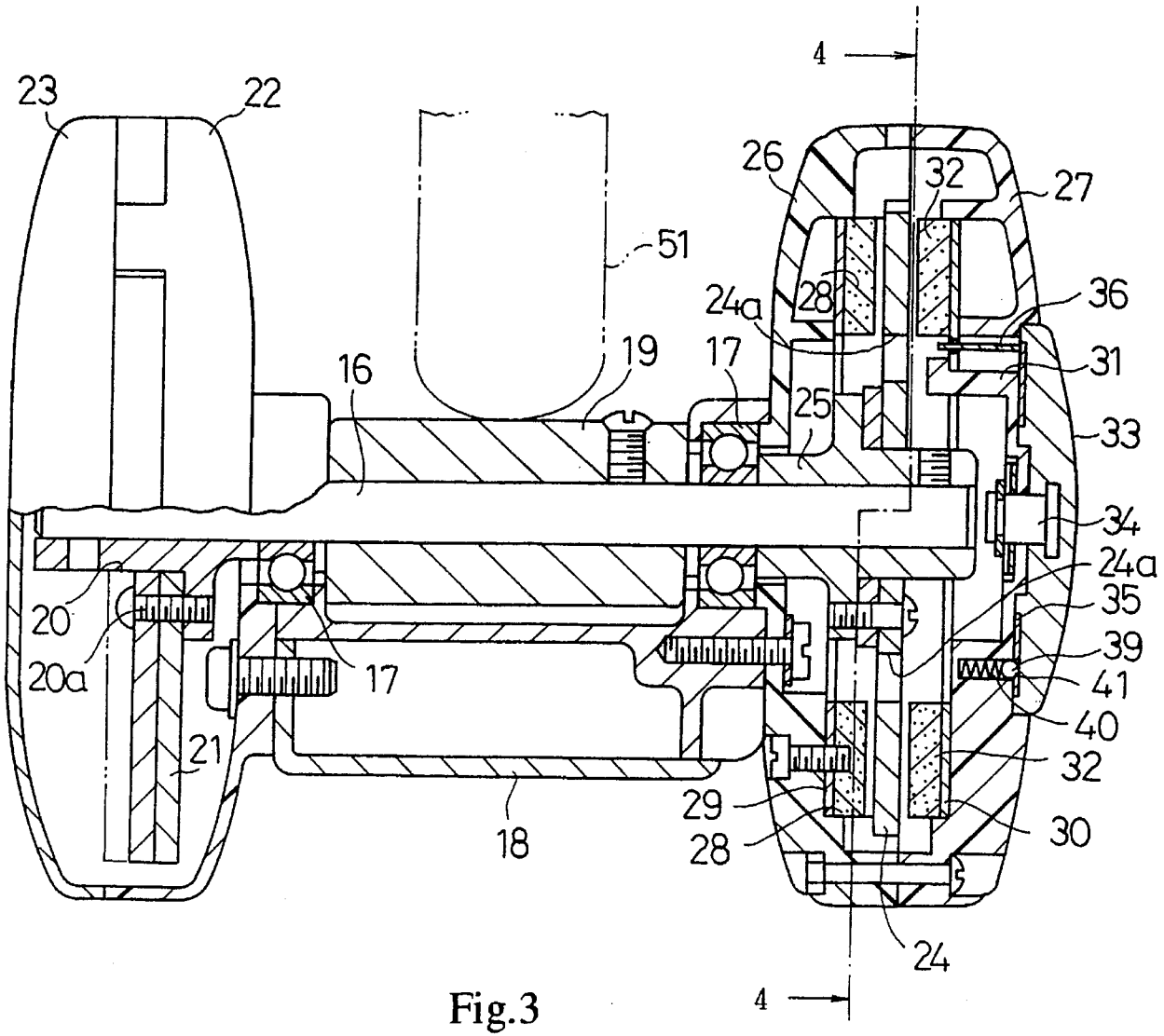
Figure 4:
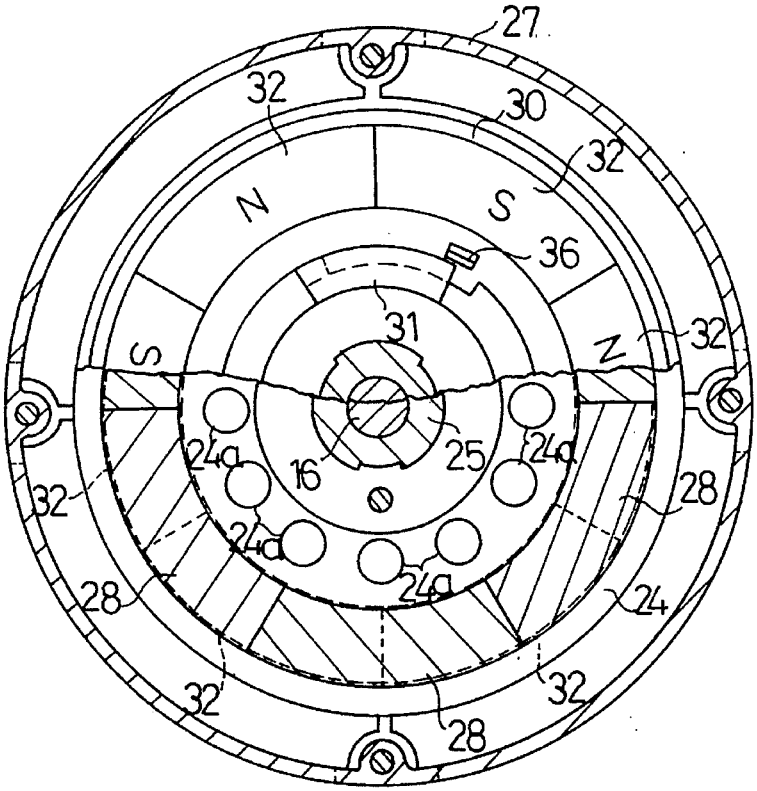

As shown in FIG. 3, a supporting disk 30 is rotatably supported inside the outer case 27, and is carried with supporting legs 31, such that the disk 30 is prevented from becoming dislodged. The permanent magnets 32 are arranged so as to form a substantially continuous circle with alternating polarities on the supporting disk 30, oppositely disposed relative to the permanent magnets 28. The permanent magnets 32 generates an eddy current on the rotary disk 24 correlating with the magnets 28, as the rotary disk 24 rotates. The eddy current causes resistance to be generated on the rotary disk 24. This resistance exerts a load on the foot pedals 52 of the bicycle 50.

Figure 5:
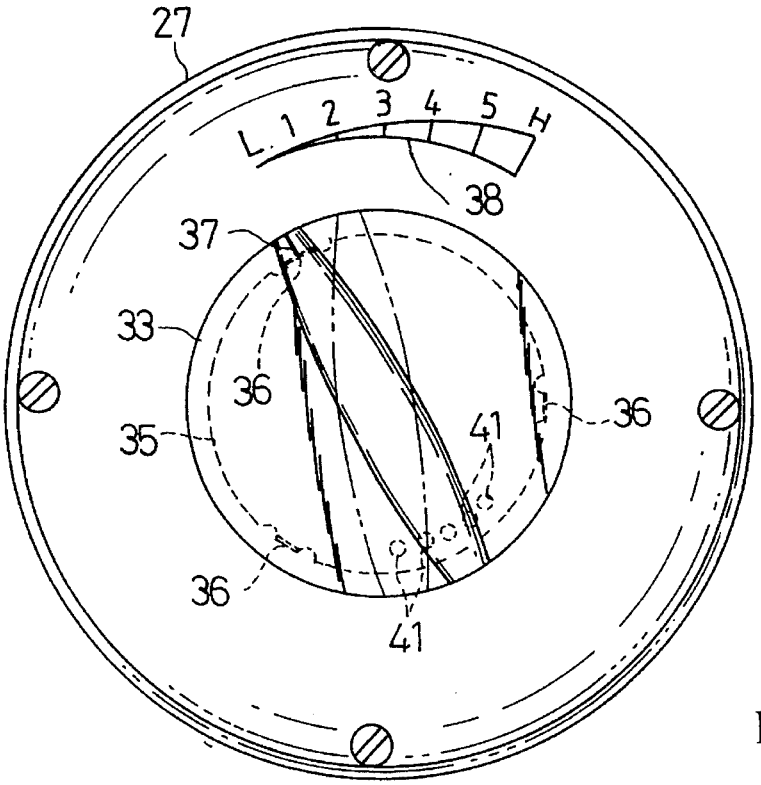

As shown in FIG. 5, an adjusting or control knob 33 is rotatably secured to the outer case 27, in order to adjust and regulate the load exerted on the foot pedals 52. As shown in FIG. 3, the adjusting knob 33 is rotatably secured to the outer case 27 by means of a pin 34, and is connected to the supporting disk 30 through connecting pieces 36. These connecting pieces 36 are formed on a connecting disk 35 on the back side of the adjusting knob 33. In the preferred embodiment, an indicator 37 is formed integrally with the adjusting knob 33, and is easily rotated by user, points to a scale 38, which is located on the outer surface of the outer case 27 to provide a visual and easily identifiable indication of the difficulty level of the exercise, or in other terms, it provides an indication of the magnitude of the desired load to be exerted on the rotary disk 24 and the foot pedals 52.

The load is low when the indicator 37 points "L" on the scale 38. In this case, the polarity of each magnet 28 is the same as that of the corresponding diametrically symmetrical magnet 32. The load is high when the indicator 37 points to "H" on the scale 38. In this case, the polarity of each magnet 28 is opposite to that of the corresponding diametrically symmetrical magnet 32. The load exerted on the foot pedals 52 is adjusted by turning the knob 33 between the "H" and "L" position. As shown in FIG. 3, an engaging ball 39 and a spring 40 are set on the outside surface of the outer case 27. The spring 40, and the ball 39 is inserted in the hole 41 formed with the connecting disk 35. Thus, the ball 39 fixes the magnets 32 to the desired position corresponding to the position of the indicator 37.

An operating mechanism of the exercise device will now be described in detail.

The driving force generated from the rear wheel 51 is transmitted to the rotary shaft 16 via the driving cylinder 19. The flywheels 21 and the rotary disk 24 rotate in a synchronous way according to the rotation of the rotary shaft 16, such that the eddy current is generated on the rotary disk 24, by means of the permanent magnets 28, 32 in order to exert the resistive load on the rotary disk 24. As a result, the load is applied to the foot pedals 52. The load on the foot pedals 52 could be regulated by shifting the relative position of the magnets 28, 32.

Figure 6:
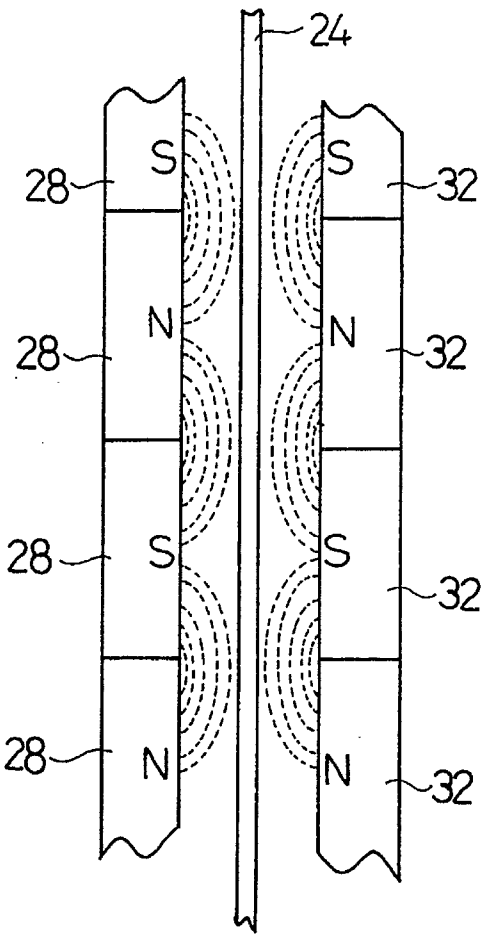
Figure 6:
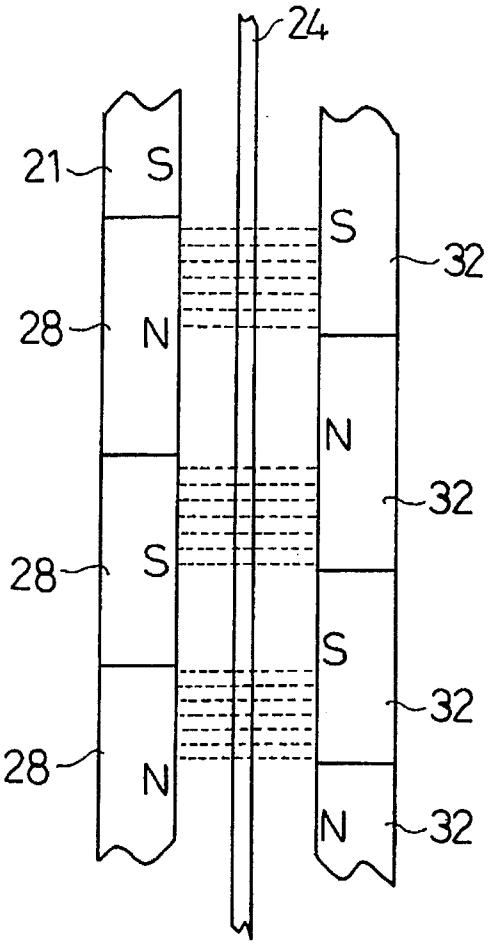
Figure 6:
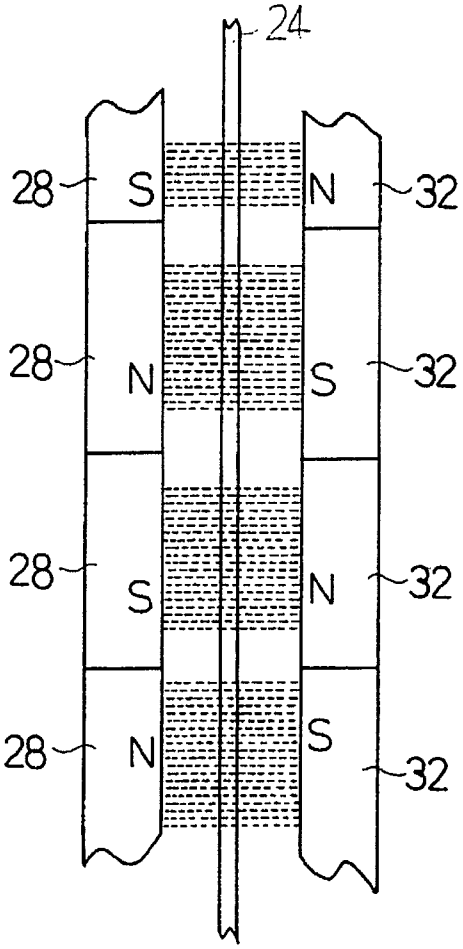

At the "L" position on the scale 38, the magnetic flux passing through the rotary disk 24 is close to zero, since the polarity of each magnet 28 is the same as that of the opposite magnet 32, as shown in FIG. 6(*a*). The eddy current is generated to exert the load against the rotation of the rotary disk 24 when it rotates across the magnetic flux. Therefore, the eddy current for creating the load is not generated while the amount of the magnetic flux is zero.

Figure 7:
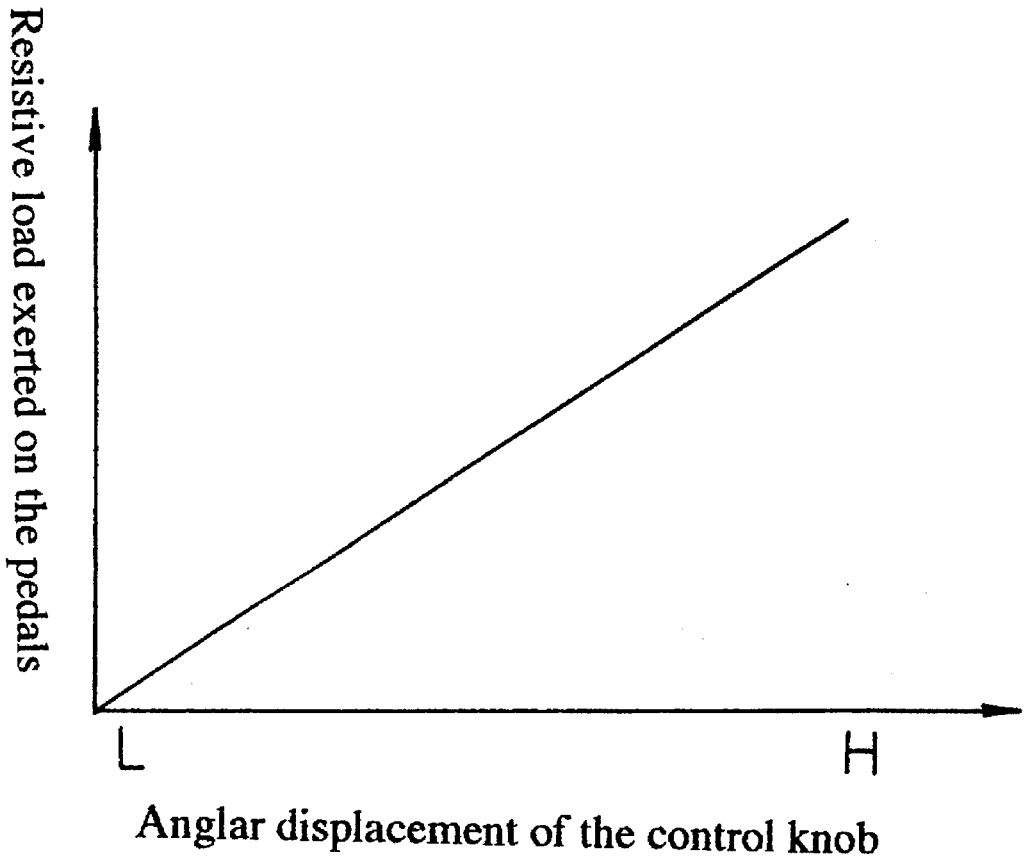
Figure 8:
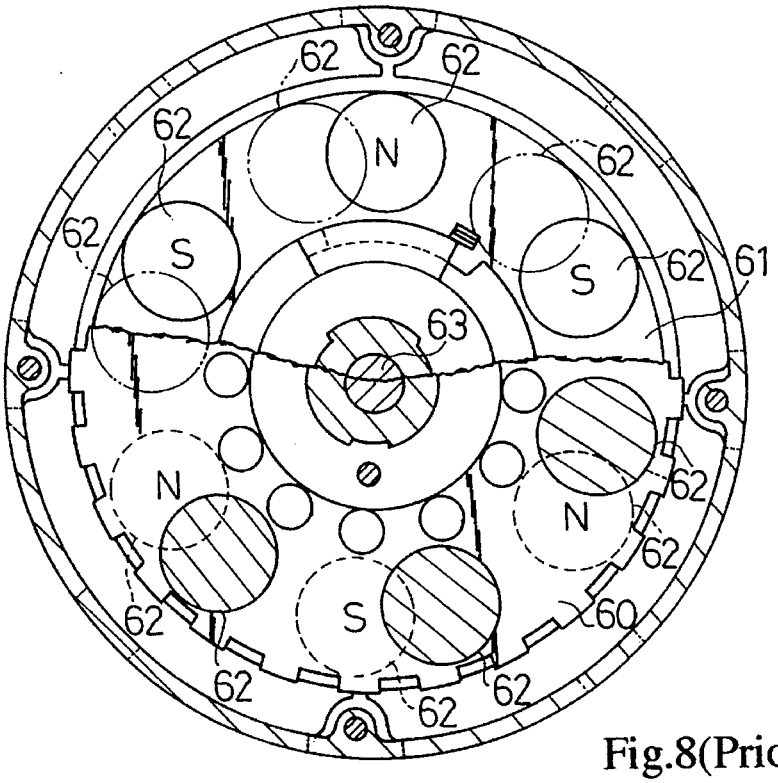
Fig.8(Prior Art)
FIG. 8 is a cross-sectional view showing the permanent magnet arrangement in a conventional resistance loading apparatus.
Figure 9:
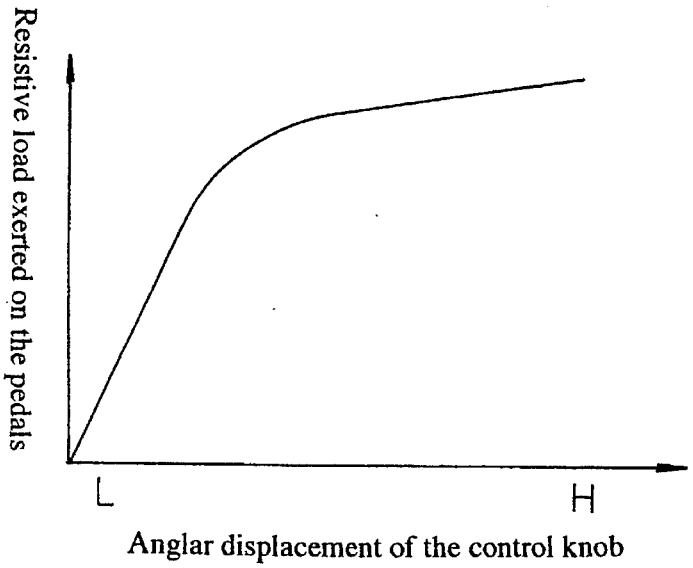
Fig.9(Prior Art)
FIG. 9 is a graph showing the relationship between the angular displacement of the control knob used in the apparatus of FIG. 8, and the resistive load exerted on the pedals.

On the other hand, at the "H" position on the scale 38, the magnetic flux is sufficiently large, and exerts a high resistive load, since the polarities of the opposite magnets 28, 32 are different as shown in the FIG. 6(*c*). The position of the magnets 32 could be continuously varied between the "H" and the "L" position on the scale 38, in order to switch the polarity relationship against the magnets 28. The magnetic flux increases linearly, so does the corresponding eddy current. As a result, the load exerted on the pedals 51 changes linearly in relation to the angular displacement of the knob 33, as shown in FIG. 7.

As explained above, by moving the knob 33 to the desired point on the scale 38, the desired load can be easily reached, since the resistive load changes linearly with respect to the angular displacement of the knob 33.

Although only one embodiment of the present invention has been described herein, it should be apparent to those skilled in the art that the present invention may be embodied in many other specific forms without departing from the spirit or scope of the invention.

For example, the arcuately-shaped magnets can be replaced by the circle-shaped magnets that are continuously juxtaposed, without any clearance therebetween. Therefore, the present examples and embodiments are to be considered as illustrative and not restrictive, and the invention is not to be limited to the details given above, but may be modified within the scope of the appended claims.

What is claimed is:

1. A loading apparatus for use with a bicycle having one wheel and a pedaling mechanism for exerting a resistive load onto the wheel, the apparatus comprising:

a rotary disk being rotatable by the pedaling mechanism to generate the resistive load;

a rotary shaft connected to the rotary disk for applying the resistive load to the wheel;

eddy current generating means for generating an eddy current on said rotary disk;

said eddy current generating means including at least two members being generally oppositely disposed relative to said rotary disk;

each one of said members including a plurality of magnets being generally, concentrically, continuously arranged about said rotary shaft, whereby adjacent magnets have alternating polarities and whereby a magnetic flux is produced by the magnets; and adjustment means for varying the magnitude of said magnetic flux, wherein said adjustment means is arranged to permit a first one of said members to move relative to a second one of said members, for gradually varying the .polarity relationship of two opposite magnets in order to adjust the resistive load as a generally linear function of the movement of said first member relative to said second member.

2. A loading apparatus according to claim 1, further including at least one flywheel for applying an inertia moment to the pedaling mechanism, via said rotary shaft; and wherein each flywheel is mounted detachably at one end of said rotary shaft.

3. A loading apparatus according to claim 2, wherein said at least one flywheel includes a variable number of flywheels for adjusting the inertia moment.

4. A loading apparatus according to claim 1, wherein said rotary disk includes a plurality of heat radiating holes that are circumferentialy arranged on said rotary disk for dissipating heat generated by said eddy current.

5. A loading apparatus according to claim 1, further including means for providing an indication of the magnitude of the resistive load; and whereby the generated resistive load varies substantially linearly with, and proportionally to an indication by said indication means.

6. A loading device according to claim 5, further including at least one flywheel for applying an inertia moment to the pedaling mechanism, via said rotary shaft; and wherein each flywheel is mounted detachably at one end of said rotary shaft.

7. A loading apparatus according to claim 6, wherein said at least one flywheel includes a variable number of flywheels for adjusting the inertia moment.

8. A loading device according to claim 5, wherein said rotary disk includes a plurality of heat radiating holes that are circumferentialy arranged on said rotary disk, for dissipating heat generated by said eddy current.

9. A loading apparatus according to claim 1, wherein the magnets are arcuately shaped.

10. A loading apparatus according to claim 1, wherein the adjustment means is a control knob attached to one of said members that allows a user to rotate said member thereby easily and quickly adjusting the resistive load as a linear function of the angular displacement of the control knob.

11. A bicycle exercise machine including a loading apparatus for use with a bicycle having one wheel and a pedaling mechanism for exerting a resistive load to the wheel, the machine comprising:

a rotary disk being rotatable by the pedaling mechanism, to generate the resistive load;

a rotary shaft connected to the rotary disk for applying the resistive load to the wheel;

eddy current generating means for generating an eddy current on said rotary disk;

said eddy current generating means including at least two members being generally oppositely disposed relative to said rotary disk;

each one of said members including a plurality of magnets being generally, concentrically, continuously arranged about said rotary shaft, whereby adjacent magnets have alternating polarities and whereby a magnetic flux is produced by the magnets;

adjustment means for varying the magnitude of said magnetic flux, wherein said adjustment means is arranged to permit a first one of said members to move relative to a second one of said members for gradually varying the polarity relationship of two opposite magnets in order to adjust the resistive load as a generally linear function of the movement of said first member relative to said second member; and at least one flywheel for applying an inertia moment to the pedaling mechanism, via said rotary shaft; and wherein each flywheel is mounted detachably at one end of said rotary shaft.

12. A bicycle exercise machine according to claim 11, wherein said at least one flywheel includes a variable number of flywheels for adjusting the inertia moment.

13. A bicycle exercise machine according to claim 11, wherein said rotary disk includes a plurality of heat radiating holes that are circumferentialy arranged on said rotary disk for dissipating heat generated by said eddy current.

* * * * *